US008117695B2

(12) United States Patent
Paz et al.

(10) Patent No.: US 8,117,695 B2
(45) Date of Patent: Feb. 21, 2012

(54) MULTI-POSITION SUPPORT APPARATUS FEATURING A MOVABLE FOOT SUPPORT

(76) Inventors: Ohad Paz, Tel Aviv (IL); Ofer Parezky, Nes Ziona (IL)

( * ) Notice: Subject to any disclaimer, the term of this patent is extended or adjusted under 35 U.S.C. 154(b) by 76 days.

(21) Appl. No.: 11/715,410

(22) Filed: Mar. 8, 2007

(65) Prior Publication Data

US 2007/0169267 A1 Jul. 26, 2007

Related U.S. Application Data

(63) Continuation-in-part of application No. PCT/IL2006/000575, filed on May 16, 2006, which is a continuation-in-part of application No. 11/130,130, filed on May 17, 2005, now abandoned, and a continuation-in-part of application No. 11/130,129, filed on May 17, 2005, now abandoned.

(60) Provisional application No. 60/738,592, filed on Nov. 22, 2005, provisional application No. 60/715,177, filed on Sep. 9, 2005, provisional application No. 60/715,147, filed on Sep. 9, 2005.

(51) Int. Cl.

| | |
|---|---|
| ***A47B 7/02*** | (2006.01) |
| *A47B 7/00* | (2006.01) |
| *A47B 71/00* | (2006.01) |
| *A47C 20/04* | (2006.01) |

(52) U.S. Cl. ..... 5/618; 5/610; 5/600; 5/651

(58) Field of Classification Search ..... 5/611, 604, 5/610, 624, 618

See application file for complete search history.

(56) References Cited

U.S. PATENT DOCUMENTS

| | | | | |
|---|---|---|---|---|
| 3,997,926 | A | 12/1976 | England | |
| 4,685,159 | A | 8/1987 | Oetiker | |
| 4,724,554 | A * | 2/1988 | Kowalski et al. | 5/610 |
| 4,724,555 | A * | 2/1988 | Poehner et al. | 5/624 |
| 5,023,967 | A | 6/1991 | Ferrand | |
| 5,195,531 | A * | 3/1993 | Bennett | 600/546 |
| 5,230,113 | A | 7/1993 | Foster et al. | |
| 5,366,036 | A * | 11/1994 | Perry | 180/65.1 |
| 5,638,563 | A | 6/1997 | Iura | |
| 6,101,646 | A | 8/2000 | Son | |
| 6,131,868 | A | 10/2000 | Welling | |
| 6,781,517 | B2 | 8/2004 | Moster | |
| 6,862,762 | B1 * | 3/2005 | Johnson et al. | 5/601 |
| 6,912,746 | B2 | 7/2005 | Grove | |
| 7,058,999 | B2 | 6/2006 | Horitani | |
| 7,296,312 | B2 * | 11/2007 | Menkedick et al. | 5/611 |

(Continued)

FOREIGN PATENT DOCUMENTS

WO WO 2006/123333 11/2006

OTHER PUBLICATIONS

Official Action Dated May 18, 2010 From the US Patent and Trademark Office Re.: U.S. Appl. No. 12/542,913.

(Continued)

*Primary Examiner* — Jonathan Liu

(57) ABSTRACT

A bed featuring a movable foot support. When the user wishes to stand up from lying down or sitting, the movable foot support moves toward the head of the bed. When the user is brought into a standing position, the movable foot support starts to come down so that the feet of the user are in close proximity to floor level.

14 Claims, 11 Drawing Sheets

U.S. PATENT DOCUMENTS

| | | | | |
|---|---|---|---|---|
| 2004/0004559 | A1 | 1/2004 | Rast | |
| 2004/0210155 | A1 | 10/2004 | Takemura | |
| 2006/0260051 | A1* | 11/2006 | Paz | 5/618 |
| 2009/0300845 | A1 | 12/2009 | Paz et al. | |

OTHER PUBLICATIONS

Response Dated Oct. 18, 2010 to Official Action of May 18, 2010 From the US Patent and Trademark Office Re.: U.S. Appl. No. 12/542,913.

Official Action Dated Sep. 27, 2010 From the US Patent and Trademark Office Re.: U.S. Appl. No. 12/542,913.

International Preliminary Report on Patentability Dated Nov. 19, 2007 From the International Bureau of WIPO Re. Application No. PCT/IL2006/000575.

International Search Report Dated Apr. 30, 2007 From the International Searching Authority Re. Application No. PCT/IL2006/000575.

Written Opinion Dated Apr. 30, 2007 From the International Searching Authority Re. Application No. PCT/IL2006/000575.

Official Action Dated Apr. 4, 2011 From the US Patent and Trademark Office Re.: U.S. Appl. No. 12/542,913.

Advisory Action Before the Filing of an Appeal Brief Dated Jun. 9, 2011 From the US Patent and Trademark Office Re.: U.S. Appl. No. 12/542,913.

Response Dated Jul. 5, 2011 to Official Action of Apr. 4, 2011 From the US Patent and Trademark Office Re.: U.S. Appl. No. 12/542,913.

Response Dated May 26, 2011 to Official Action of Apr. 4, 2011 From the US Patent and Trademark Office Re.: U.S. Appl. No. 12/542,913.

* cited by examiner

MULTI-POSITION SUPPORT APPARATUS FEATURING A MOVABLE FOOT SUPPORT

RELATED APPLICATIONS

This application is a Continuation-In-Part of PCT Patent Application No. PCT/IL2006/000575, filed on May 16, 2006. PCT/IL2006/000575 is a Continuation-In-Part (CIP) of U.S. patent application Ser. No. 11/130,129, filed on May 17, 2005, and U.S. patent application Ser. No. 11/130,130, filed on May 17, 2005, and claims priority from U.S. Provisional Patent Application No. 60/715,147, filed on Sep. 9, 2005, U.S. Provisional Patent Application No. 60/715,177, filed on Sep. 9, 2005, and U.S. Provisional Patent Application No. 60/738,592, filed on Nov. 22, 2005.

This application is also related to PCT Patente Application No. PCT/IL2006/000574, filed on May 16, 2006.

The disclosures of the above applications are incorporated herein by reference.

FIELD OF THE INVENTION

The embodiments of the present invention relate to supporting apparatus and, more particularly, to multi-position support apparatus featuring a movable foot support.

BACKGROUND

Hereinafter, the term "engine" or "drive" refers to any device that is able to move things, including, but not limited to motor, and actuator.

Basic principles and details relating to multi-position support apparatus featuring a movable foot support needed for properly understanding the embodiments of the present invention are provided herein. Complete theoretical descriptions, details, explanations, examples, and applications of these and related subjects and phenomena are readily available in standard references in the fields of physics, electronics, home care devices, and elderly care.

Many different types of multi-position support apparatus have been described in the prior art for supporting a user in many different positions, and for moving the user from one position to another. To date, the inventors are unaware of prior art teaching of a multi-position support apparatus featuring an arrangement for supporting a user in a resting position, such as a horizontal lying position, a seating position and/or a reclining position, and for moving the user to a vertical standing position, or vice versa, in a manner enabling the user to conveniently step-away from the apparatus after having moved to a vertical standing position. Nor are the inventors aware of prior art including an arrangement for supporting the user in a sitting position and for moving the user to a selected reclining position, or vice versa, wherein the back support is slidable with respect to the frame structure to reduce a change in the pressure on the user's back by the change in the angle between the back and the support when moving from one position to another.

There is thus a need for, and it would be highly advantageous to have a multi-position support apparatus having the above features.

BRIEF SUMMARY

According to one aspect of the present invention, there is provided supporting apparatus for supporting a user in one of a plurality of positions, and for moving the user from one of said positions to another, comprising: a frame structure including a base for supporting the apparatus on a horizontal surface; a body support carried by the frame structure and including a back support, a seat pivotally mounted at one end to the back support, and a leg support pivotally mounted to the opposite end of the seat, all having outer surfaces engaging the user when supported in a selected position; and drive means for driving the body support from one of the positions to another; characterized in that the body support further includes a feet support movable with respect to the leg support to an intermediate location thereon for engaging and supporting the user's feet in a selected position, a motor drive for driving said feet support with respect to said leg support to engage the user's feet in said selected position, and a pressure sensor carried by said feet support for sensing the pressure applied thereto by the user's feet, and for controlling the motor drive in response to said pressure to prevent shifting in position of the user's body when the body support moves from one of said positions to another.

According to another aspect of the present invention, there is provided supporting apparatus for supporting a user in a resting position and for moving the user to a vertical standing position, or vice versa, comprising: a frame structure including a base for supporting the apparatus on a horizontal surface; a body support carried by said frame structure and including a back support and a leg support both having outer surfaces for engaging the user when supported in said resting position; and drive means for driving said body support to move the user supported thereon from said resting position to said vertical standing position, or vice versa; characterized in that said body support further includes a feet support movable with respect to the lower end of said leg support by said drive means: (a) in a first direction towards said back support to engage the bottom surface of the user's feet and thereby to prevent downward sliding of the user when the body support is driven by said drive means from said resting position to said vertical standing position; and (b) in a second direction away from said body support and towards the horizontal surface, when the user is moved to said vertical standing position, while supported by said feet support, to enable the user to easily step away from said supporting apparatus onto said horizontal surface.

The embodiments of the present invention are readily implemented using standard hardware components and standard software modules. Moreover, the embodiments are generally applicable as a 'stand-alone' multi-position support apparatus, or as a multi-position support apparatus used in combination with other methods, devices, and systems, performing various operations.

Implementation of the multi-position support apparatus embodiments involves performing or completing selected tasks or steps manually, semi-automatically, fully automatically, and/or a combination thereof. Moreover, depending upon actual instrumentation and/or equipment used for implementing a particular embodiment of the disclosed system and corresponding method, several embodiments could be achieved by hardware, by software on any operating system of any firmware, or a combination thereof. In particular, as hardware, embodiments of the invention could exist by variations in the physical structure. Additionally, or alternatively, as software, selected functions of the invention could be performed by a data processor, such as a computing platform, executing a of computer program types of software instructions or protocols using any suitable computer operating system.

BRIEF DESCRIPTION OF THE DRAWINGS

The embodiments of the present invention are herein described, by way of example only, with reference to the accompanying drawings. With specific reference now to the drawings, it is stressed that the particulars shown are by way of example and for purposes of illustrative discussion of the embodiments of the present invention only, and are presented in order to providing what is believed to be the most useful and readily understood description of the principles and conceptual aspects of the embodiments. In this regard, no attempt is made to show structural details of the embodiments in more detail than is necessary for a fundamental understanding of the invention, the description taken with the drawings making apparent to those skilled in the art how the several forms of the invention may be embodied in practice. In the drawings.

DETAILED DESCRIPTION

The embodiments of the present invention relate to supporting apparatus and, more particularly, to multi-position support apparatus featuring a movable foot support.

The embodiments of the present invention are not limited by the details of the order or sequence of steps of operation or implementation of the methods and/or the details of construction, arrangement, and composition of the components of the devices set forth in the following description, drawings or examples. While specific steps, configurations and arrangements are discussed, it is to be understood that this is done for illustrative purposes only. A person skilled in the relevant art will recognize that other steps, embodiments, configurations and arrangements may be used without departing from the spirit and scope of the embodiments of the present invention.

The embodiments of the present invention are capable of other embodiments or of being practiced or carried out in various ways. Also, it is to be understood that the phraseology, terminology and notation employed herein are for the purpose of description and should not be regarded as limiting.

Elderly people have difficulty bending over and moving from a standing position to a sitting position, and vice versa. People with severe knee problems also have difficulty bending their knees. As a result, the action of sitting down on a bed is difficult for them. Overweight and/or obese people sometimes find it difficult to bend their knees when sitting down on a bed, and have difficulty rising up from a bed.

For simplicity, hereinbelow the terms "bed", "multi-position bed" and "multi-position support apparatus" should have the save meaning.

The multi-position support apparatus featuring a movable foot support receives and lowers the user from a standing position (while both the bed and user are about vertical), into a reclining or horizontal position, optionally without having to tie and/or secure the user to the bed before the angular position change occurs. Then, when the user wants to get out of bed, the bed raises the user from lying down to standing up.

In one embodiment, the multi-position support apparatus features wheels which enable it to move. In an alternative embodiment, the wheels which enable the bed to move are motorized. In the case where the wheels which enable the bed to move are motorize, it is possible to control the movement of the bed using a control panel. The control panel allows the user to operate the different engines separately, and/or to perform complete operations such as transition from a standing position to a sitting position and vice versa, transition from a standing position to a lying position and vice versa, and transition from a sitting position to a lying position and vice versa. Optionally, the control panel allows the user to stop the multi-position support apparatus in any of the intermediate states of the above described complete operations.

Figure 1:
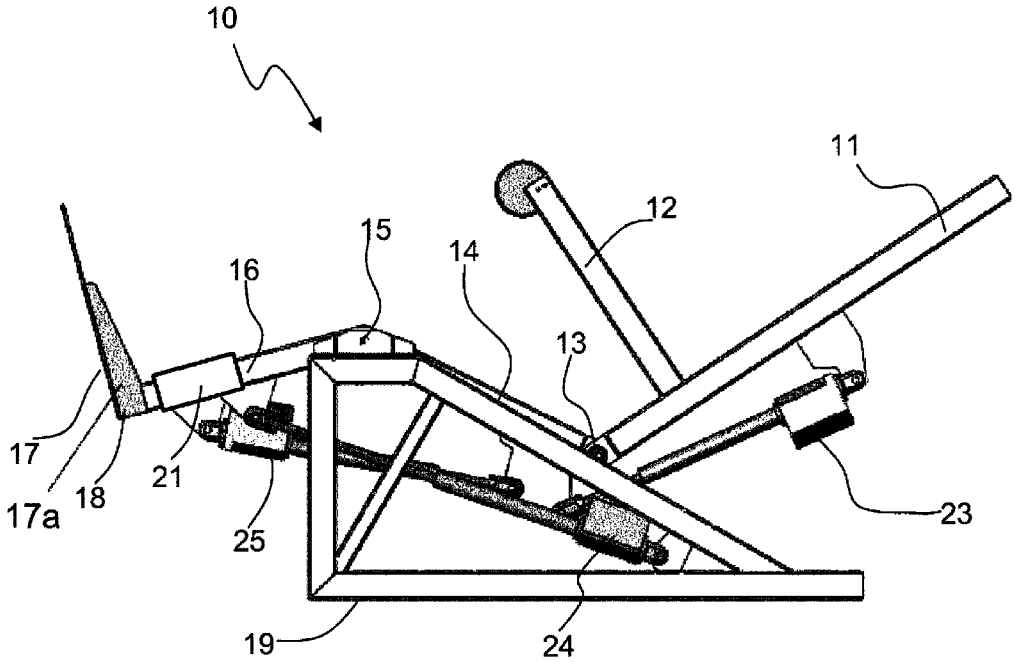
FIG. 1 is an illustration of a multi-position support apparatus in accordance with the present invention.
Figure 2:
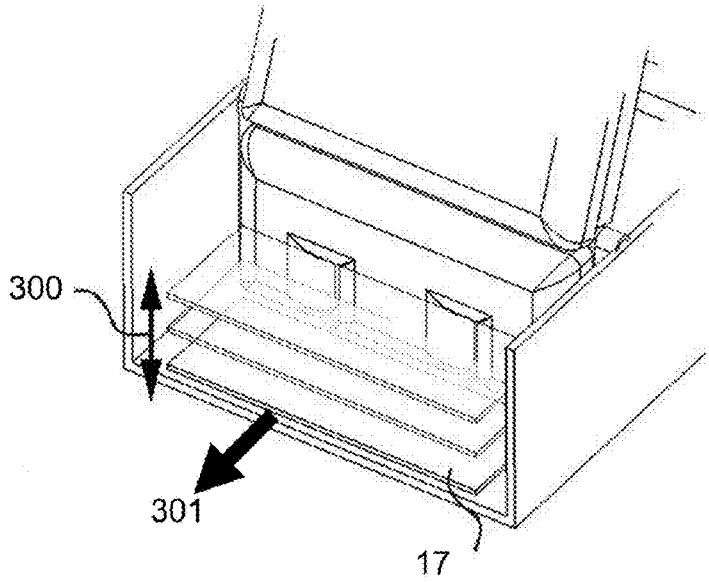
FIG. 2 is an illustration of a movable foot support in accordance with the present invention.

Referring to the figures, FIG. 1 and FIG. 2 illustrate embodiments with the movable foot support 17. In an optional embodiment, movable foot support 17 is a motorized movable foot support. The movable foot support 17 prevents the user from sliding as the bed shifts from a lying position to a standing position and/or when the bed shifts from a sitting position to a standing position. When the user wishes to stand up from lying down or sitting, the movable foot support 17 moves toward the head of the bed until it reaches the user's feet. Optionally, the movable foot support 17 is actuated by a motor 21.

Detecting when the foot support has reached the feet of the user lying in the bed may be achieved in various ways, such as, but not limited to, using a pressure sensor, schematically shown at 17*a* in FIG. 1, that measures the pressure thereon, that is, the user's legs intensity of the resistance, and controls the motor 21 in accordance therewith. The sensed pressure may thus be used for controlling the motor drive to prevent shifting in position of the user's body when the body support moves from one position to another. The minimal threshold of intensity measured by the sensor should be set to a value that is high enough to ensure that the movable foot support 17 has actually reached the user's feet, and not another object that may be on the bed. For example, as a safety precaution, the user is not brought to a standing position while stepping on a blanket or a pillow.

However, if the user purposely wants to be brought to a standing position while stepping on a blanket or a pillow, the pressure sensor should be configured and set to ensure that a minimal predefined amount of pressure is applied, implying that the object is pressed to the user's feet. Only when the appropriate amount of pressure is measured by the sensor, the bed begins to rise to a standing position.

In one embodiment, when the user wishes to shift from a lying position to a sitting position, it is possible to waive the movement of foot support. Alternatively, it is possible to enable the bed to begin moving when the amount of pressure measured by the sensor is smaller than the predefined amount of pressure required for beginning the shifting from a lying position to a standing position.

In one embodiment, when the user wishes to be brought to a standing position, the multi-position support apparatus starts to change its angular position simultaneously while the foot support moves towards the direction of the head of the multi-position support apparatus. Performing these two actions simultaneously saves time and does not endanger the user, as long as movable foot support 17 reaches the user's feet in a reasonable amount of time in relation to the angular position of the multi-position support apparatus.

In one embodiment, when the multi-position support apparatus starts to recline from its standing position, the foot support is raised before its angular position is changed in order to prevent a situation wherein the back edge of the foot support is scraped on the floor.

In order to prevent the user from having to descend a step when brought into standing position, and optionally to avoid friction of the user on the mattress, when the multi-position support apparatus reaches a predefined angle, movable foot support 17 starts to come down so that the feet of the user are in close proximity to ground level.

Figure 3:
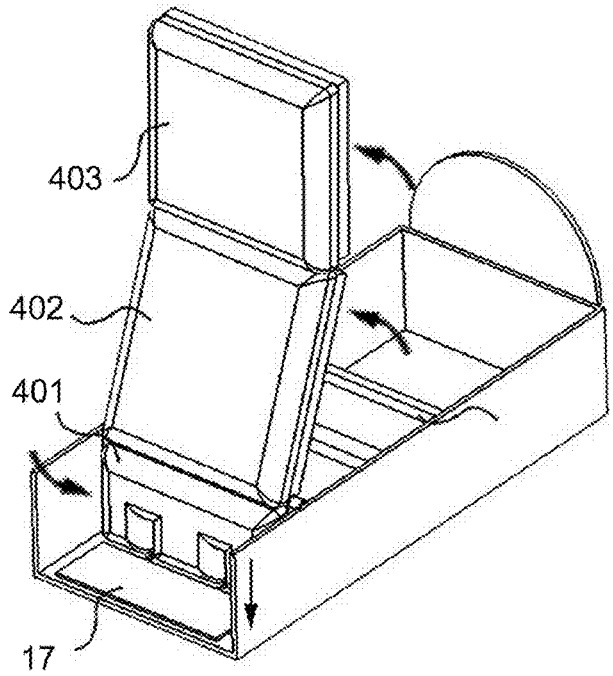
FIG. 3 is an illustration of a multi-position support apparatus featuring a movable foot support in accordance with the present invention.

In one embodiment, the engine of movable foot support 17 may be positioned either underneath the multi-position support apparatus or on the side of the multi-position support apparatus. In one embodiment, movable foot support 17 may be connected to its operating engine through slots in the mattress, as illustrated in FIG. 2, FIG. 3, and by reference numerals 500 and 502 in FIG. 4. Alternatively, movable foot support 17 may be connected to its operating engine using at least one arm-like extension reaching out from at least one side of the multi-position support apparatus (not shown in the figures). In this alternative embodiment it is not required that the mattress be slotted. Referring to FIG. 2, movable foot support 17 can move along axis 300 or along axis 301.

In one embodiment, the bed may also be used as a chair. In one embodiment, the bed may be moved into a sitting position, like a TV recliner.

Referring to FIG. 3, one embodiment comprises the following elements: (a) Foot support 17 able to move towards the head of the bed when the bed is in positions other than standing, and towards the ground when the bed is in standing position (i.e. about vertical), or moves towards a standing position. (b) Multi-position support apparatus. (c) Optionally, the multi-position support apparatus being covered by a mattress. In one embodiment, the mattress is equipped with the means for it to be attached to the bed. Non-limiting examples of attachment means are nails, screws, hooks, press-studs, strips, and strips with Velcro.

In one embodiment, at least one safety bracket, optionally coupled to a micro-switch or other sensor, ensures that the user may move around the bed safely. Optionally, the bed controller sets the safety bracket state as function of the user's position.

In one embodiment, the bed is equipped with a toilet bowl. Optionally, when the toilet bowl is being used, the bed shifts to a sitting position. Optionally, the toilet bowl usage is indicated by the user via a control panel (not shown in the figures).

In one embodiment, a foldable tray is attached to the multi-position support apparatus. The foldable try may be used as a base for placing various objects such as food, drinks, dishes, books, a remote control, a telephone, a computer, an alarm clock, etc. The foldable tray may be folded in any way known in the art. To prevent objects placed on the foldable tray from falling down, as the multi-position support apparatus is changing its angular position, the foldable tray may be moved aside either manually by the user, or by an engine powered by any means known in the art.

In one embodiment, the bed may be raised vertically (i.e. up and down). The ability to raise the bed vertically is useful and convenient for when a user is receiving ambulatory treatments, physical examinations, getting therapy, massage, and/or any other treatments known in the art. By raising and lowering the bed, the bed's height may be adjusted to the height of the caregiver.

In one embodiment, the bed's armrests are not fixed to any moving parts of the bed. Thus, the user may place a blanket or any other object on the armrests before the bed is shifted from one position to another, without the object falling from the arm rests. Optionally, the bed includes a special shelf and/or tray on which various objects may be placed so that they will not fall down when the bed shifts from one position to another.

In the following description of the device, included are only main or principal details needed for sufficiently understanding proper 'enabling' utilization and implementation of the disclosed device. Accordingly, descriptions of the various required or optional minor, intermediate, and/or, sub systems, which are readily known by one of ordinary skill in the art, which are available in the relevant prior art and technical literature.

Figure 4:
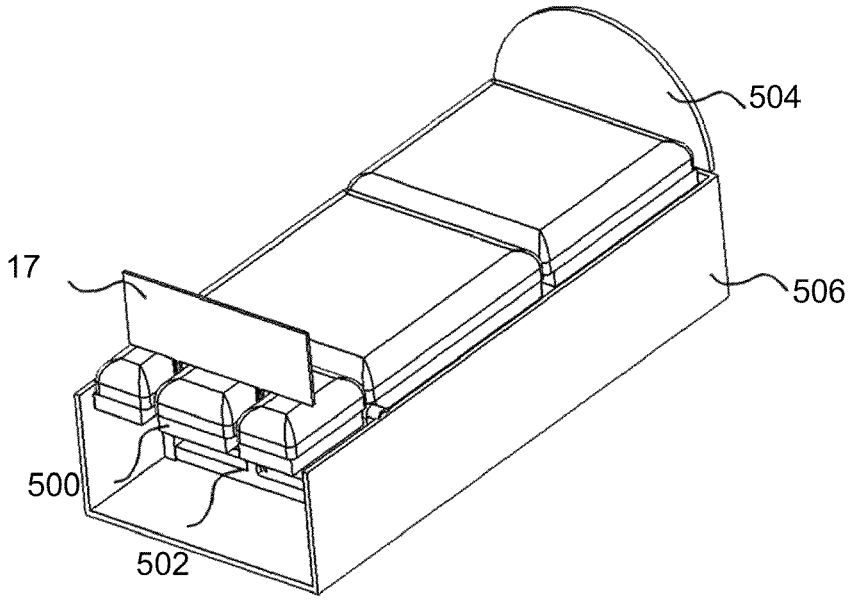
FIG. 4 is another illustration of the multi-position support apparatus featuring a movable foot support in accordance with the present invention.

Referring to FIG. 1, one embodiment of the multi-position support apparatus 10 features at least the following: back support 11, back-seat angle 13, seat 14, seat-leg angle 15, leg support 16, movable foot support 17, and multi-position support apparatus base 19. Moreover, the multi-position support apparatus 10 optionally features at least one hand support 12 and leg-foot angle 18. One embodiment comprises back-seat angle 13, seat-leg angle 15, and leg-foot angle 18 featuring a pivot, as known in the art. FIG. 3 illustrates another embodiment featuring back support 403, seat 402, seat-leg angle 401, and leg support featuring movable foot support 17. Multi-position support apparatus 10 uses engines to change its angular position. For decorative or space-saving purposes, the multi-position support apparatus 10 may be designed with all or most of the engines controlling its angular position concentrated beneath seat 14. FIG. 4 illustrates one embodiment of the bed in horizontal position with elements 504 and 506.

In one embodiment, the angles of the multi-position support apparatus 10 are programmed so that the user returns to the standing position with maximum stability; slightly reclined. Because of its slightly reclined angle in a standing position, the multi-position support apparatus 10 does not throw the user off-balance. It is to be noted that the term "reclining" may be interpreted as "backward inclining". All the angles of the multi-position support apparatus 10 may be pre-programmed and prevent the user from getting to predefined positions.

Figure 7:
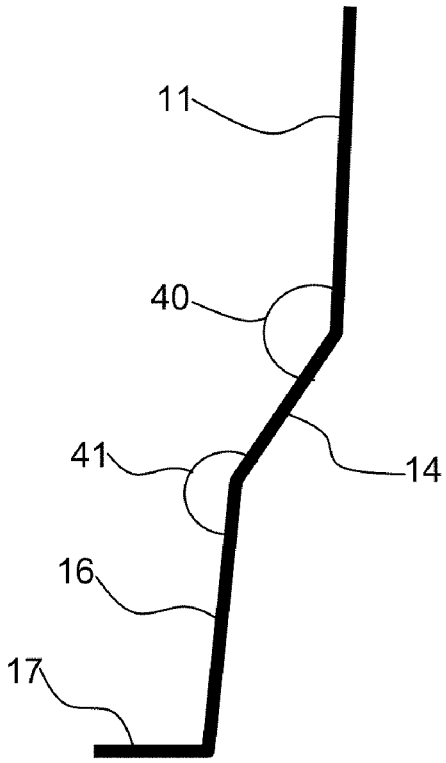
FIG. 7 is an illustration of one angle in accordance with the present invention.

FIG. 7 illustrates the angles of multi-position support apparatus 10 in standing position. Either in a standing position or when entering a standing position, angle 41 is larger than 180 degrees in order to prevent the user from falling. Angle 40 should be smaller than 180 degrees, but not smaller than a predefined angle, which is dependent on the angular position of multi-position support apparatus 10 in its entirety. The control system of the embodiments of the present invention functions to prevent the user from manually reducing angle 40 beyond an angle wherein exists the possibility that the user will fall forward from the multi-position support apparatus. By using the disclosed embodiments, the probability of accident is reduced. Receiving the user from a standing position—and returning the user to a standing position—minimizes the probability of bed-related accidents occurring.

The disclosed embodiments are useful for people who cannot stand. In that case, the device is receiving the user from a sitting position—and returning the user to a sitting position.

A fast angular change may cause dizziness in elderly people, for example as a result of orthostatic hypotension. Optionally, the speed at which multi-position support apparatus 10 changes its angular position may be controlled and adjusted for the comfort and health condition of the user. Optionally, when the angular position changes, it is possible to stop the apparatus by using the control panel or any other controlling device. As indicated above, during the transition from laying position to standing position, elderly people might suffer from orthostatic hypotension and may feel weakness, muscle tonus decrease, and even possibly faint. Muscle tonus decrease during transition to standing position may result in the user falling off the bed. During the transition from laying position to standing position, the user is leaned against the bed until the user is standing. The danger in loosing muscle tonus is slipping down or to the side of the bed, and even falling forwards.

In one embodiment, in order to recognize muscle tonus decrease and prevent the falling, the bed features a muscle tonus monitoring device. Muscle tonus monitoring may be achieved by various devices known in the art. When the muscle tonus monitoring device detects a critical reduction in user's muscle tonus, the bed automatically brings the user back to a safe reclining position. Optionally, movable protective barriers are raised on the sides of the bed, thus preventing the user from slipping to the side. The movable protective barriers may be motorized movable protective barriers.

Movable foot support 17 pushes the user's feet forward by moving on axis 301 as illustrated in FIG. 2. Thus, legs of the user are used as a lever and prevent the user from falling forward. Moreover, the lever effect helps to lean the body of the user against the bed. Optionally, the user's knees are pushed forward, resulting in knees bending. Along with the feet, which are pushed forward, the user is brought to a safe position. The knees and feet are pushed forward, rather than the body of the bed is brought backward. Thus, the bed fully supports the body of the user, keeping constant contact with the user. Keeping constant contact with the user and no gap between the user's body and the bed reduces the probability of falling of the bed. Optionally, in seating position with legs up, the foot support moves forward out of the multi-position support apparatus, giving the legs the ability not to be bent to uncomfortable position. The multi-position support apparatus is gradually returning to reclining position, constantly keeping contact with the body of the user.

FIG. 1 illustrates one embodiment of the multi-position support apparatus 10, capable of entering into positions of standing, sitting and reclining. The engines are connected to the various parts of the multi-position support apparatus 10. For example, the engines are connected to the back support 11, seat 14, and leg support 16. In another optional embodiment (not shown in the figure), the engines are connected to the device's pivots. For example, two engines may be connected to the back-seat angle 13 and the seat-legs angle 15.

The angle of back support 11, seat 14, and leg support 16, changes during operation in order to achieve maximum stability and put minimal pressure on the legs. In one embodiment, the user enters the apparatus in a standing position, leans backwards, and upon achieving a reclined angle of 20 to 60 degrees, the apparatus begins to move the user into a sitting position. When the apparatus moves from sitting to standing the user is first brought to an inclined position of between 20 and 60 degrees, and only then is brought to a full standing position.

As indicated above, in one embodiment, one or more sensors 17*a* (FIG. 1) are placed in the foot support 17, or on the foot support 17, or in other possible locations. Such sensors may also be used for preventing a situation in which the multi-position support apparatus 10 descends on the foot of an operator who is not the user, such as a nurse. The one or more sensors detect objects and prevent foot support 17 from crushing them. Examples for optional sensors are, but are not limited to, infra-red sensor, electric footboard that sends a signal when it is stepped upon, micro switch, camera, or any other sensor known in the art.

In one embodiment, one or more sensors are placed in or on back support 11. The one or more sensors prevent a situation in which back support 11 crushes an operator who is not the user, such as a nurse, by detecting objects and prevent back support 11 from crushing them. Examples for optional sensors are, but are not limited to, infra-red sensor, electric footboard that sends a signal when it is stepped upon, micro switch, camera, or any other sensor known in the art.

In order to achieve a reclining position (180 degrees), it is possible to create an indentation in the pivot area so that the pivot will fall into the indentation when the multi-position support apparatus is stretched, as required for a reclining position.

Optionally, one embodiment of the armrests of the multi-position support apparatus may move up, down, and to the sides, to enhance the user's comfort. Optionally, the armrest may be detached from the multi-position support apparatus. In this case, when the multi-position support apparatus moves, the armrests are not moving along with it, to allow the user to comfortably reach for an object or shelf during changes in position.

Figure 8:
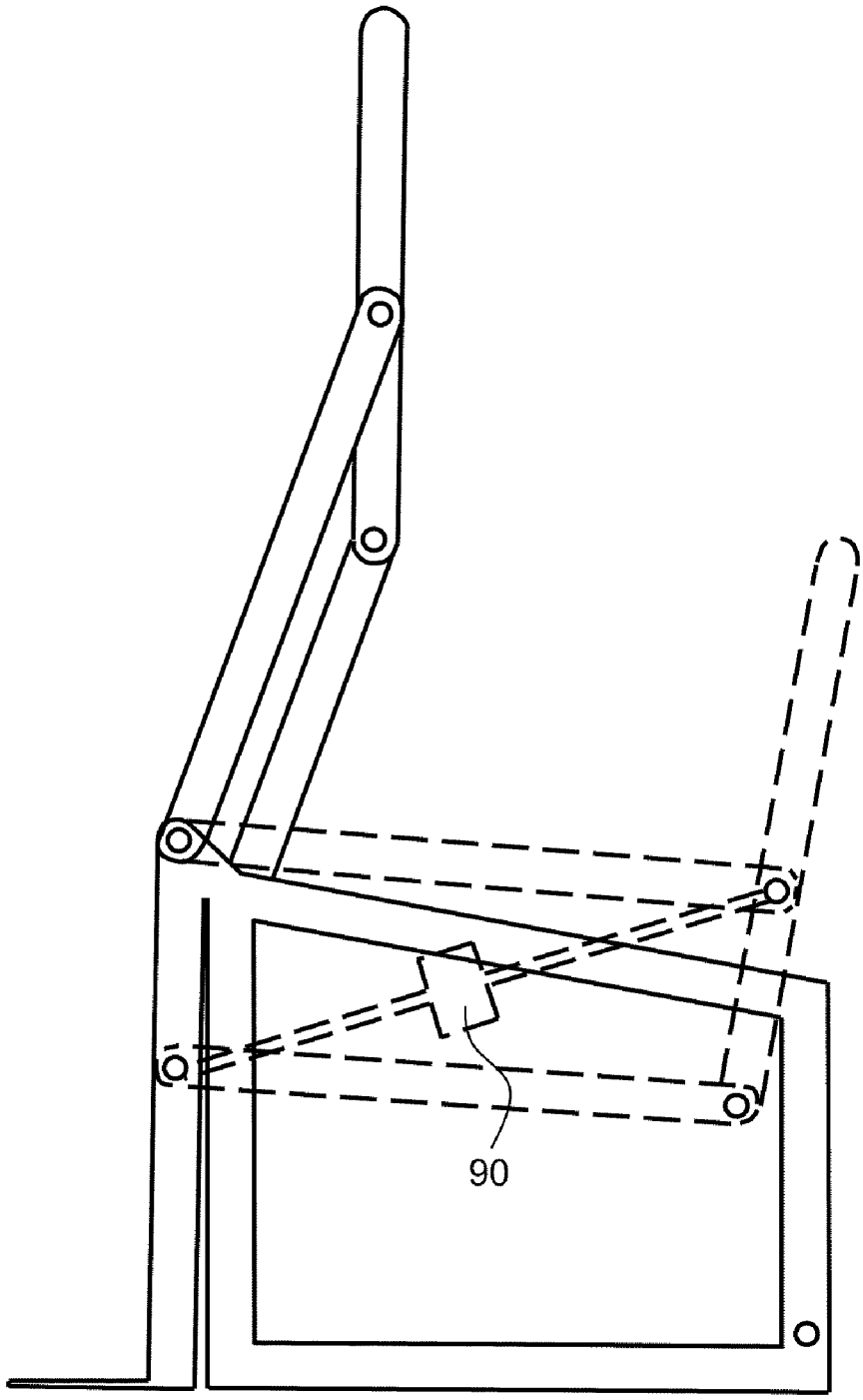
FIG. 8 is another illustration of a multi-position support apparatus featuring one engine in accordance with the present invention.
Figure 9:
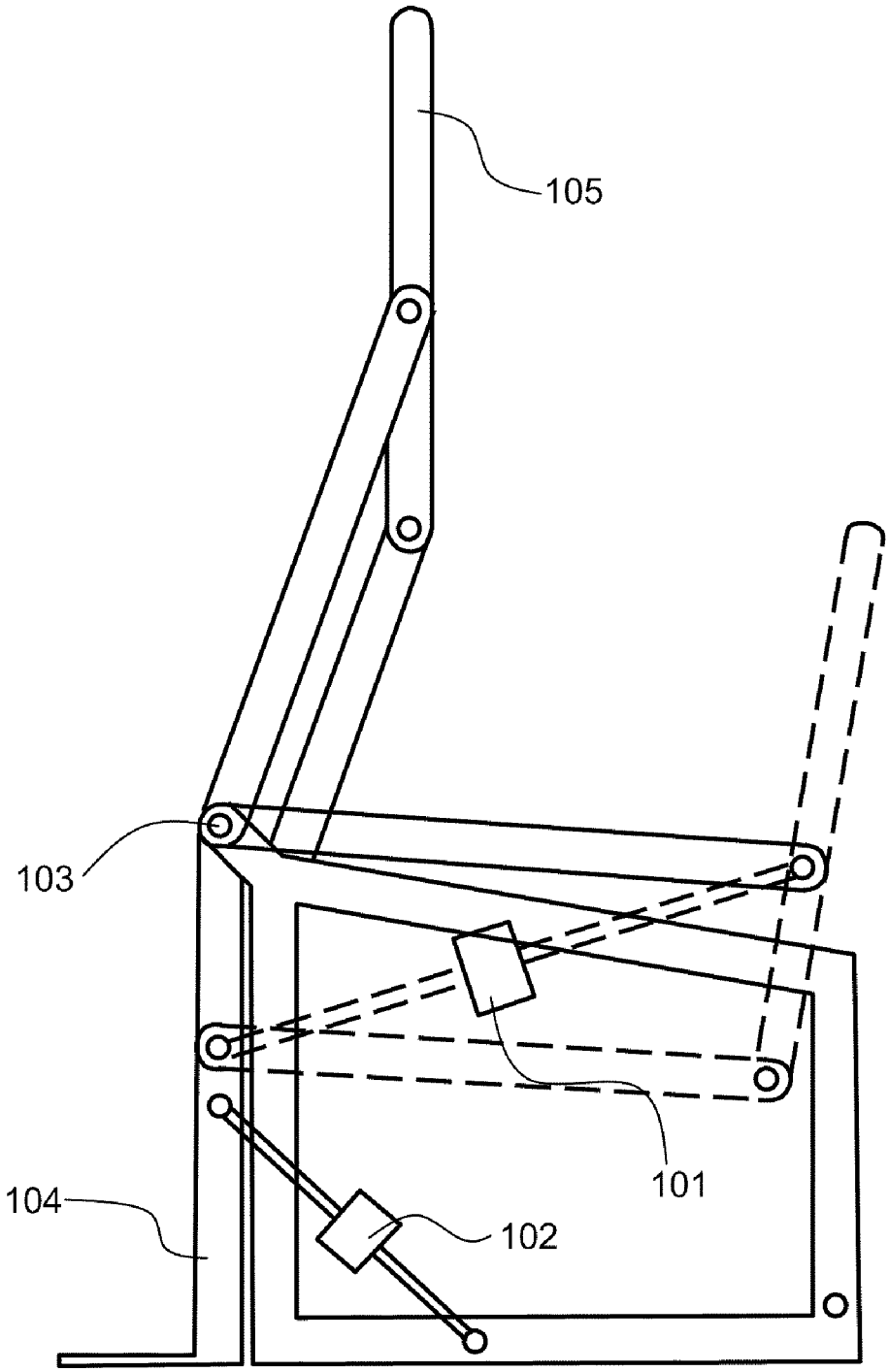
FIG. 9 is an illustration of a multi-position support apparatus featuring two engines in accordance with the present invention.

FIG. 8 illustrates a parallelogram-based structure with one engine 90 which enables the multi-position support apparatus to shift from a standing position to a sitting position or from a sitting position to a reclining position. Engine 90 operates a rod that can decrease or increase in length. When the rod's length grows, the device shifts to a reclining position. The leg-support and back-support move nearly together and therefore one engine may be used for both. FIG. 9 illustrates a parallelogram-based structure device with two engines. The operation of the first engine is identical to that of the parallelogram-based structure device with one engine. Operation of the second engine raises and lowers the device. 101 is an engine for shifting from a sitting to a standing position. The apparatus is fixed to axis 103. The purpose of engine 102 is to shift the apparatus from a sitting to a lying position. It is to be noted that in the parallelogram-based structure device, 104 and 105 are parallel and move in tandem. In a non-parallelogram-based structure device, it is sometimes possible to control each of the parts independently or almost independently.

Figure 10:
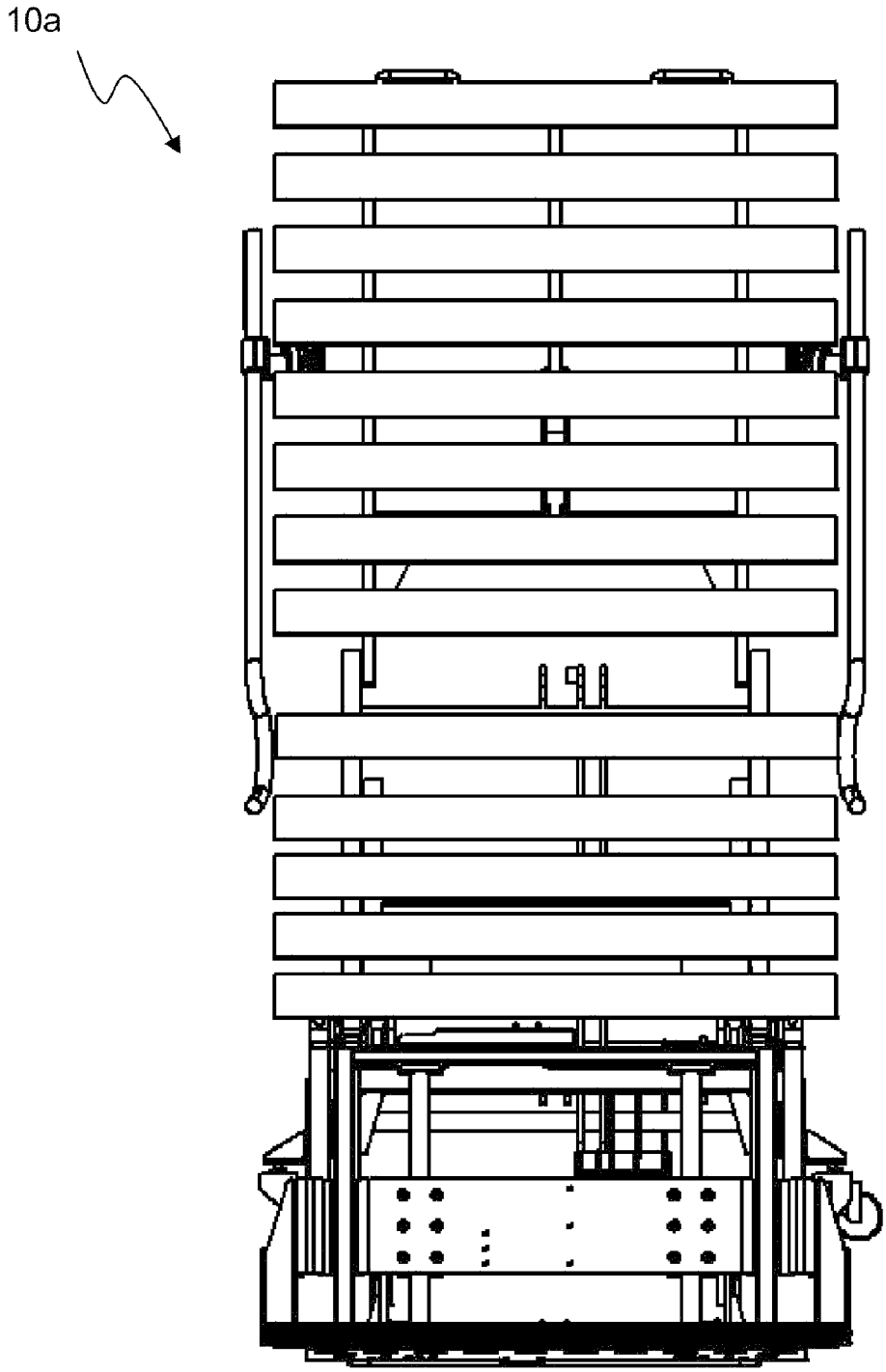
FIG. 10 is a front view illustration of one embodiment of the multi-position support apparatus in standing position.
Figure 11:
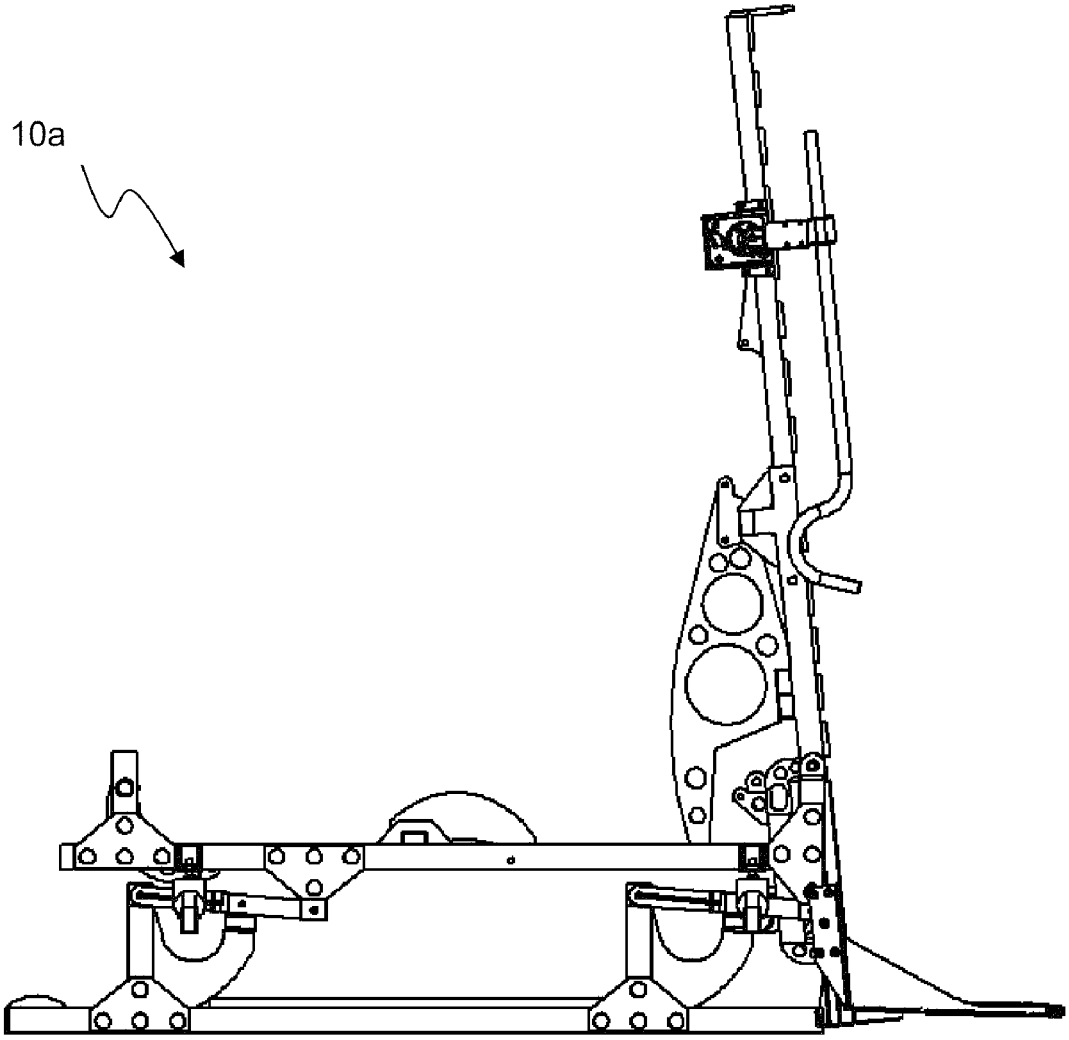
FIG. 11 is a right view illustration of one embodiment of the multi-position support apparatus in standing position.
Figure 12:
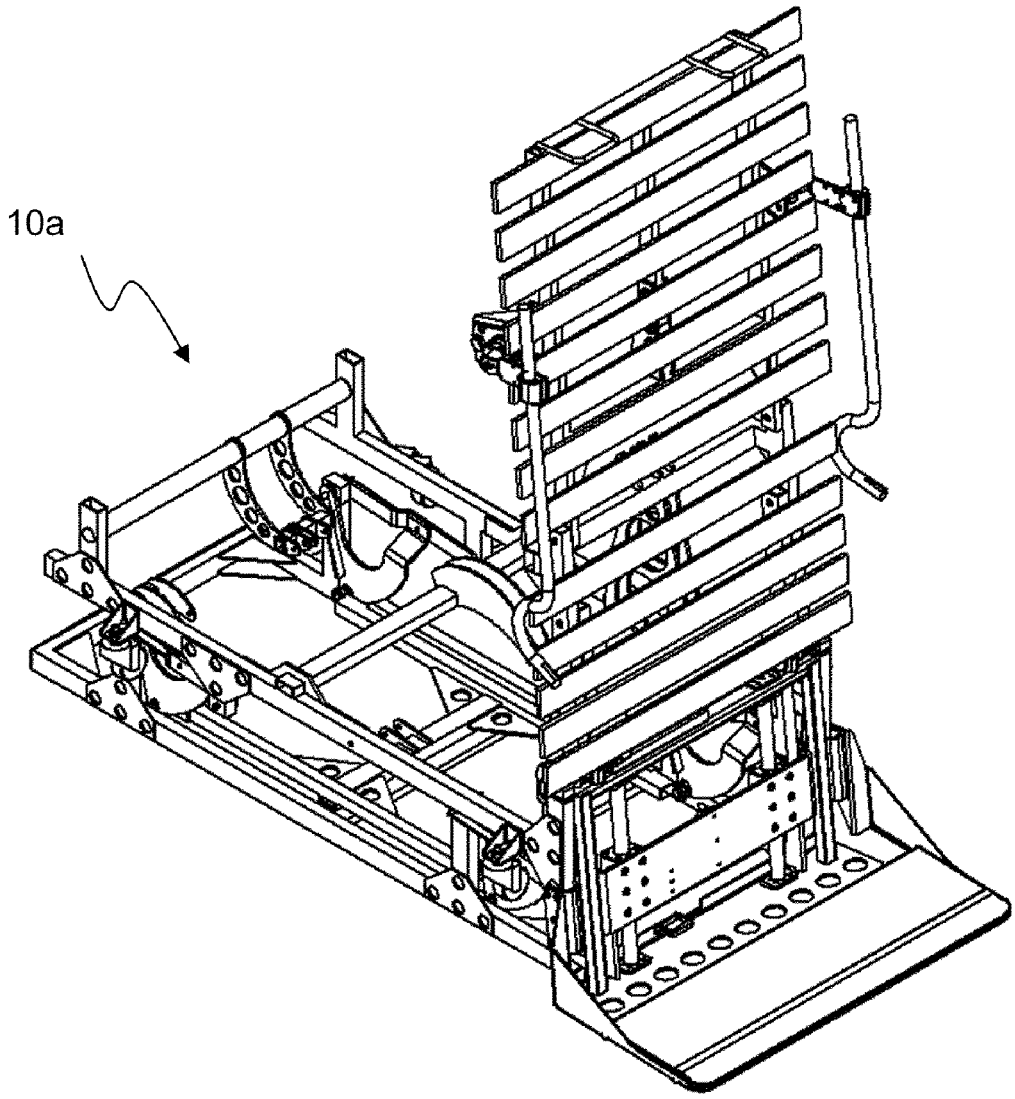
FIG. 12 is an isometric view illustration of one embodiment of the multi-position support apparatus in standing position.
Figure 13:
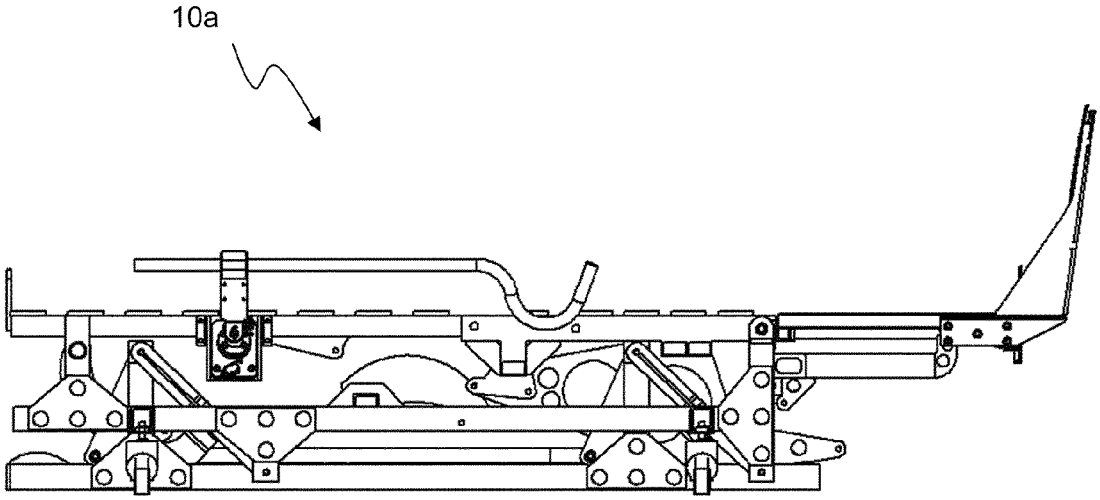
FIG. 13 is a side view illustration of one embodiment of the multi-position support apparatus in lying position.
Figure 14:
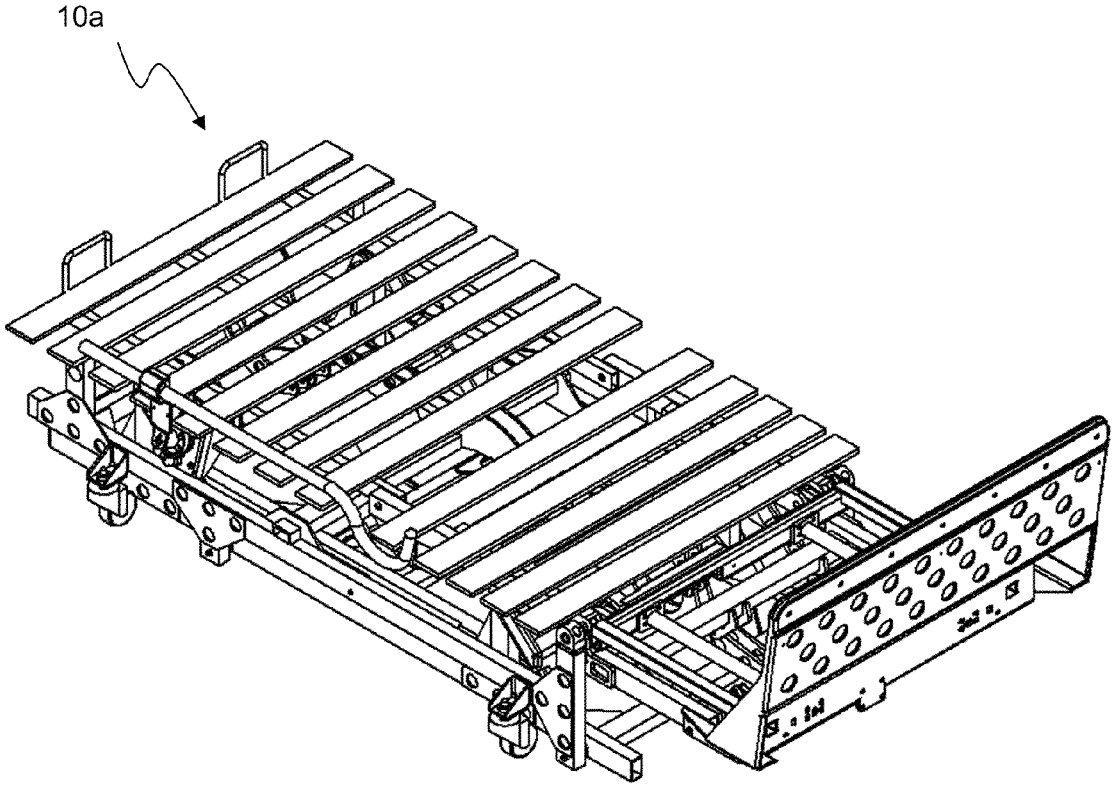
FIG. 14 is an isometric view illustration of one embodiment of the multi-position support apparatus in lying position.

FIGS. 10-14 illustrate one, non-limiting, embodiment of the multi-position support apparatus, referenced by 10*a*. FIG. 10 is a front view illustration of the multi-position support apparatus 10*a* in standing position; FIG. 11 is a right view illustration of the multi-position support apparatus 10*a* in standing position; FIG. 12 is an isometric view illustration of the multi-position support apparatus 10*a* in standing position; FIG. 13 is a side view illustration of the multi-position support apparatus 10*a* in lying position; and FIG. 14 is an isometric view illustration of the multi-position support apparatus 10*a* in lying position.

Referring to FIG. 1, one embodiment shows the states of engines 23, 24, and 25 setting the angular position of multi-position support apparatus 10. The use of three or more engines to control the angular position of the multi-position support apparatus 10 enables further adjustment of the movement of the multi-position support apparatus 10, for the comfort of the user. The multi-position support apparatus 10 may include more than three parts where each part may feature a separate engine.

In one embodiment, the multi-position support apparatus 10 features different lengths and therefore caters to users of various heights. Therefore, the length of the multi-position support apparatus 10 should be adjusted to the height of the user. Adjustment of multi-position support apparatus 10 to the user's height may be accomplished by controlling the lengths of leg-support 16 and back-support 11.

Figure 5:
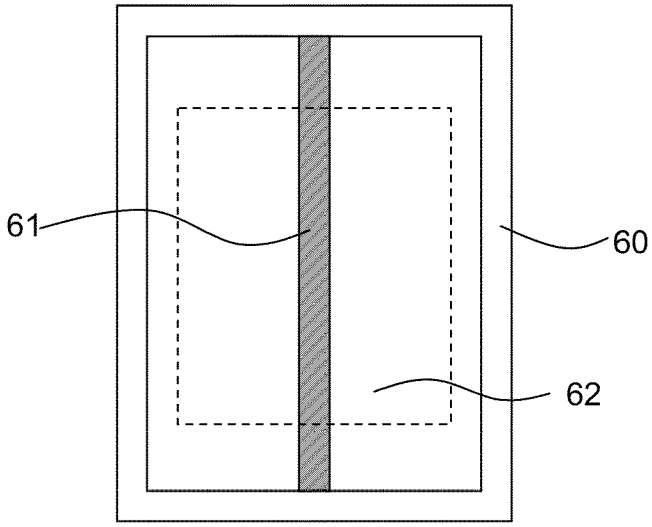
FIG. 5 is an illustration of floating back support in accordance with the present invention.

In one embodiment the multi-position support apparatus 10 is with mattress. In that case, when the multi-position support apparatus 10 shifts from sitting position to reclining position, the user's body may slide down. This motion may cause uncomfortable friction to an unclothed body. To prevent the friction, it is possible to enable the multi-position support apparatus 10 to move according to the motion of a user. For example, enabling the back of the bed to move according to the motion of a user's back. Referring to FIG. 5, the back support 62 is floating over the back-support frame 60. In one embodiment, the floating of the back support 62 over the back-support frame 60 is achieved by slides 61. In an optional embodiment, one or more of the following parts may be floating parts: head support, back support, and leg support.

According to another option, the floating is achieved by using the following optional embodiments: (a) Two or more tracks. Hereinafter, the term "track" refers to any device that enables movement along a specific direction. (b) Using a spring to hold the floating part in place for ensuring that the floating part does not move independently. To prevent quick movement by the spring it is possible, for example, to integrate the spring with a piston. (c) Using a telescopic device. An exemplary telescopic device is shock absorbers such as those used in motorcycles or automobile luggage compartments (trunks). The functionality of the telescope device is to ensure that the support is not moving by itself and/or not moving independently when the user momentarily gets up. The use of a telescopic device is just an example and floating parts may be implemented with any other device known in the art. As long as no command is given to change the angular position of the multi-position support apparatus 10 and/or as long as the engine is idle, the floating part's position on the slide is fixed. This may be achieved by using a pin, step motor, electro-magnet, etc. In this case, the telescopic device is not needed, as the floating part is not moving independently. The floating device moves along at least one track. Examples of optional track configurations include a track down the middle, two tracks down the sides of the back-support, or any other equivalent implementation.

Optionally, instead of using a floating device, the movement may be achieved by using an engine. The control commands to the engine may be derived from measuring in advanced the distance the user's back should move as function of the angular position of the chair/apparatus.

The starting positions of the floating parts may be determined according to the specific user's height. In that case, the multi-position support apparatus adjusts to different heights of users by moving the floating parts' positions according to the user's height. The taller a person is, the further apart the floating parts' starting position is in the apparatus' standing position.

Hereafter the floating parts of the multi-position support apparatus embodiment are described. Referring to FIG. 1, parts 11 and 14 are nearest to one another in a standing position. For example, in order to prevent uncomfortable friction when the apparatus changes its angular position, parts 11 and 14 move closer together as the apparatus shifts from a sitting to a reclining position. Another option is using floating parts without active control that are laced on a slide. When the user sits, parts 11 and 14 move away from one another. When the user lies down, parts 11 and 14 move closer together. To sum up, when shifting from a standing to a sitting position the parts should move away from each other, and when shifting from sitting to reclining the parts should move closer.

The example of the floating-parts solution may be implemented on any of the users' body supporting parts, including the backseat and leg supports. Because relative movement is needed, it may be sufficient that only the back-support part and/or the leg-support part be floating. In this case, it is not necessary for the seat to move, because the back-support and/or leg-support are moving.

In one embodiment, a feces-collecting device, referred to herein as "integrated toilet", may be integrated into the multi-position support apparatus 10. The integrated toilet features significant hygienic advantages. Examples of integrated toilets include a toilet, toilet bowl, and lavatory seat.

There are cases where there is a need to secure the user to the multi-position support apparatus 10. For example, when the user is an elderly person suffering from Alzheimer's disease, dementia or amnesia. The user may be secured to the device using any means known in the art. For example, multi-position support apparatus 10 side-handles that close-in/wrap the user and hold the user in place, and/or support straps attached to the sides of the multi-position support apparatus 10.

Figure 6:
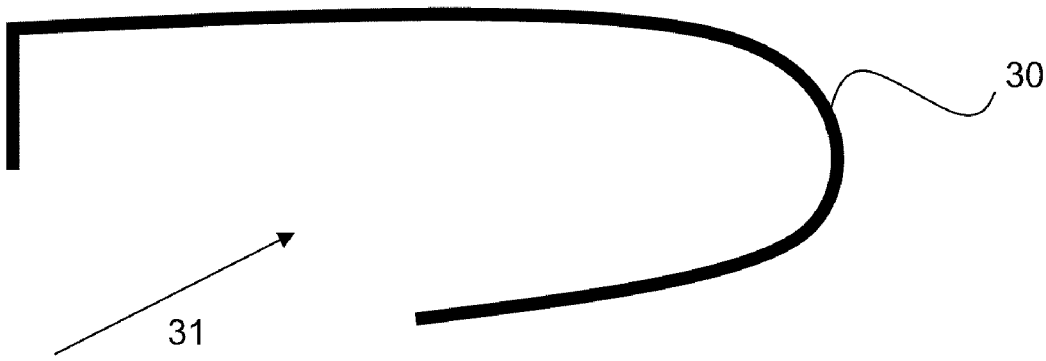
FIG. 6 is an illustration of an arm rest in accordance with the present invention.

FIG. 6 is an illustration of armrest 30, which enables a user to enter the multi-position support apparatus 10 from a comfortable and safe direction 31. Entering multi-position support apparatus 10 comfortably is achieved using two handles, armrests, or hand supports, featuring different lengths. On one side, a short handle allows easy entry into the device; on the other side, a long handle both supports the user and prevents the user from falling from the apparatus. Moreover, the user may be secured at the knees while standing, to increase safety and stability.

In one embodiment, it is possible to control the operation of the device by one or more means of the following options: (a) Operating the device using a control button that enables choosing the desired program. (b) Operating the device using a controller that identifies voice commands. (c) Automatic operation of the device by means of user-identification. (d) Identifying the user may be achieved by any method known in the art. For example: by means of voice or visual aids, RFID, smart card, key, user's weight, control panel, etc.

After the device identifies the user, a personalized program may be executed. Angles and velocities are examples of some of the parameters which may be saved in the personalized program.

In one embodiment, the device is operated manually. The manual operating program activates each step/stage according to instructions from either the user or any other human operator. Alternatively, the device is operated by an automatic program that activates all stages, sequentially. Alternatively, the device is operated by one of the following, or by a combination thereof: (a) the user, (b) an operator who is not the user, (c) from any place where it is possible to control the device's operations via remote control or any other remote operating means as known in the art, or, (d) automatically, using methods known in the art.

In one embodiment, prior to executing the program, the device activates a voice indicator which informs the user about the program to be executed. The program is activated only after the user confirms the voice-indication. The user may confirm execution of the program by any input means known in the art, such as pressing a confirmation button, or by voice-command.

In one embodiment, the device features an interface from which a variety of operations are controlled. For example, the controller may be operated by the following means: manual, keyboard, voice-activation, computer-connected, for example via RS232 or USB, remote activation such as by telephone or wireless network, or by any other means known in the art. In one embodiment, all or some of the parameters that have been user-customized, such as user programs, angles, heights, and angular change velocity, are backuped. Parameters customized for the user may be saved in the device or in any computer, or memory element, capable of communicating with the bed.

In one embodiment, the device features a Built in Test (BIT). The BIT system may be used for fast identification of failures. This capability enables a technician to determine what action should be taken. The BIT also makes it easier to provide price quotes to a user prior to responding for repairs. Optionally, the BIT results may be transferred to the technician's equipment via a phone line or wireless network, or any other known in the art communication aid.

In one embodiment, when installing the device at the user's site, the technician is able to set a combination of velocities, movement angles, and other parameters referred to herein as "operational customized parameters" of the device such that it is possible to fit the use of the device to the requirements, comfort and safety of the specific user. Optionally, the operational customized parameters are saved in a memory element for future use.

In an emergency, the bed may operate a predefined emergency response operation, such as, but not limited to, bringing the user to a predefined angular position. The angular position, into which the user is brought in an emergency, may the most secure angular position for the specific user. Entering the emergency response operation may be initialized by any kind of appropriate device, such as, but not limited to, emergency button, emergency pull-rope, voice command, and etc.

The embodiments of the present invention are not limited to the details of the order or sequence of steps of operation or implementation of the embodiments and corresponding method set in the description, drawings, or examples of the embodiments of the present invention.

Citation or identification of any reference in this application shall not be construed as an admission that such reference is available as prior art to the embodiments of the present invention.

While the invention has been described in conjunction with specific embodiments and examples thereof, it is to be understood that they have been presented by way of example, and not limitation. Moreover, it is evident that many alternatives, modifications and variations will be apparent to those skilled in the art. Accordingly, it is intended to embrace all such alternatives, modifications and variations that fall within the spirit and broad scope of the appended claims and their equivalents.

What is claimed is:

1. Supporting apparatus for supporting a user in one of a plurality of positions, and for moving the user from one position to another, comprising:

a frame structure including a base for supporting the apparatus on a horizontal surface;

a body support carried by the frame structure and including a back support, a seat pivotally mounted at one end to the back support, and a leg support pivotally mounted to the opposite end of the seat, all having outer surfaces for engaging the user; and drive means for driving the body support from one of the positions to another;

characterized in that the body support further includes a feet support movable with respect to the leg support to an intermediate location thereon for engaging and supporting the user's feet in a selected position, a motor drive for driving said feet support with respect to said leg support to engage the user's feet in said selected position, and a pressure sensor carried by said feet support so as to be moved therewith for sensing the pressure applied thereto by the user's feet, and for controlling the motor drive in response to said pressure to prevent shifting in position of the user's body when the body support moves from one of said positions to another.

2. The supporting apparatus according to claim 1, wherein said back support is slidable with respect to the frame structure to prevent sliding of the user, and also to reduce pressure changes in the user's back by angle changes between the back support and feet support, when the body support is moved from one position to another.

3. The supporting apparatus according to claim 1, wherein said body support further includes a mattress over said outer surfaces of said back support, seat and leg support, said feet support being movable over the outer surface of said mattress to a location thereon corresponding to an intermediate location of the leg support.

4. The supporting apparatus according to claim 1, wherein said pressure sensor also senses the pressure applied to said foot support when moved away from said head support to detect objects and to control said motor drive in response to such detection.

5. The supporting apparatus according to claim 1, wherein said supporting apparatus is movable to move the user to a vertical standing position; and wherein said feet support is also movable by said drive motor away from said intermediate location of the leg support, when the user is moved to the vertical standing position, to enable the user to step away from said supporting apparatus when in said vertical standing position.

6. The supporting apparatus according to claim 1, wherein said body support may also be driven to support the user in a horizontal lying position, as well as in a sitting or reclining position.

7. The supporting apparatus according to claim 6, wherein said drive means includes:

a first drive underlying said leg support for driving said feet support in both directions with respect to said leg support;

a second drive for driving said leg support with respect to said back support; and a third drive for driving said back support with respect to said frame structure.

8. Supporting apparatus for supporting a user in a resting position and for moving the user to a vertical standing position, or vice versa, comprising:

a frame structure including a base for supporting the apparatus on a horizontal surface;

a body support carried by said frame structure and including a back support and a leg support both having outer surfaces for engaging the user when supported in said resting position;

and drive means for driving said body support to move the user supported thereon from said resting position to said vertical standing position, or vice versa;

characterized in that said body support further includes a feet support movable with respect to the lower end of said leg support by said drive means;

(a) in a first direction towards said back support to engage the bottom surface of the user's feet and thereby to prevent downward sliding of the user when the body support is driven by said drive means from said resting position to said vertical standing position; and (b) in a second direction away from said back support and towards the horizontal surface, when the user is moved to said vertical standing position, while supported by said feet support, to enable the user to easily step away from said supporting apparatus onto said horizontal surface;

and further characterized in that said feet support includes a pressure sensor moved with said feet support for sensing the pressure applied thereto by the user's feet, and for controlling the drive means in response to said pressure to prevent shifting of the user's body when the body support moves from one position to another.

9. The supporting apparatus according to claim 8, wherein said body support further includes a mattress over said outer surface of said back support and said leg support, said feet support being movable with respect to the outer surface of said mattress to a location thereon corresponding to an intermediate location of the leg support.

10. The supporting apparatus according to claim 8, wherein said outer surface of the back support engageable with and supporting the user's back is slidable with respect to said frame structure to reduce a change in the pressure on the user's back by the angle change of the back support when moving the body support from one position to another.

11. The supporting apparatus according to claim 8, wherein said rest position of the user is or includes a horizontal lying position of the user on said body support.

12. The supporting apparatus according to claim 8, wherein said rest position of the user includes both a horizontal lying position and a sitting or reclining position of the user on said body support.

13. The supporting apparatus according to claim 12, wherein said body support further includes a seat between, and pivotally coupled at its opposite ends to, said back support and leg support.

14. The supporting apparatus according to claim 13, wherein said drive means includes:

a first drive underlying said leg support for driving said feet support in both directions over the outer surface of said leg support;

a second drive for driving said leg support with respect to said back support; and a third drive for driving said back support with respect to said frame structure.

* * * * *